United States Patent [19]

Melby

[11] Patent Number: 4,664,379

[45] Date of Patent: May 12, 1987

[54] HOCKEY STICK

[76] Inventor: George R. Melby, 15534-96th St., N.E., Elk River, Minn. 55330

[21] Appl. No.: 738,942

[22] Filed: May 29, 1985

[51] Int. Cl.[4] ..... A63B 59/14

[52] U.S. Cl. ..... 273/67 A

[58] Field of Search ..... 273/67 R, 67 A, 67 DC, 273/1 B; D21/210, 211, 212, 213, 218; 30/356

[56] References Cited

U.S. PATENT DOCUMENTS

| | | | |
|---|---|---|---|
| 430,388 | 6/1890 | Kinut | D21/211 |
| 1,098,070 | 5/1914 | Whitney | 273/67 R |
| 1,452,930 | 4/1923 | Polk | 30/356 |
| 3,489,412 | 1/1970 | Fronek et al. | 273/67 R |
| 3,563,546 | 2/1971 | Dawe | 273/67 A |
| 3,720,410 | 3/1973 | Saytor | 273/67 A |

FOREIGN PATENT DOCUMENTS

| | | | |
|---|---|---|---|
| 879243 | 8/1971 | Canada | 273/67 A |
| 652157 | 10/1937 | Fed. Rep. of Germany | 30/356 |

*Primary Examiner*—Richard C. Pinkham
*Assistant Examiner*—Matthew L. Schneider
*Attorney, Agent, or Firm*—Merchant, Gould, Smith, Edell, Welter & Schmidt

[57] ABSTRACT

This invention relates to sticks of the type used in ice hockey or similar games and, more particularly, relates to an improved blade design having a backhand curve and a forehand curve for increased accuracy and control in handling and shooting a hockey puck.

8 Claims, 3 Drawing Figures

10
12
14
16
18
20
22
B
F
LINE OF SIGHT

HOCKEY STICK

BACKGROUND OF THE INVENTION

The present invention relates to sticks of the type used in ice hockey or similar games and, more particularly, relates to an improved blade design.

For many years hockey players have been using hockey sticks having curves in the blade on the forehand side. This forehand curve enables players to project a hockey puck with greater accuracy on a forehand shot, as compared to a stick with no curvature, known as a neutral stick. For various reasons, as explained in U.S. Pat. No. 3,902,250 to T. B. Lawson, the curvature of hockey stick blades has now been restricted by hockey officials.

While curved sticks improved forehand shots for most hockey players, they simultaneously increased the difficulty of projecting a puck with a backhand shot. This is due to the fact that, due to the concave forehand curve, there was less flat blade area on the backhand side to use for hitting or slapping the puck. Further, the forehand curve makes it more difficult to hold or control the puck from the backhand side. This is particularly true for school-aged players.

SUMMARY OF THE INVENTION

The present invention overcomes the difficulties presented by the forehand curved stick, while retaining the benefits thereof. In the present invention for the first time a concave backhand curve is provided on the blade which results in improved control of the puck when it is handled on the backhand side, including improved shot accuracy. Surprisingly, due to the positioning of the backhand curve in relation to the forehand curve, the present invention also results in improved accuracy and control on forehand shots.

Further, the invention in its preferred embodiment provides a line of sight to the backhand side, enabling the hockey player to have an improved view of the puck.

In summary, the present invention comprises an elongated linear handle which is secured at an obtuse angle to a blade having a rounded inner end defining a heal, an outer end, a forehand side and a backhand side. The blade has a first longitudinal concave curve on the backhand side extending from the heel to about the midpoint of the blade. The blade also has a second longitudinal concave curve on the forehand side extending from about the point of maximum curvature of the first longitudinal curve to the outer end. Another feature of the invention is to preferably provide a line of sight to the backhand side by tapering the backhand side inward from the heel to about the midpoint of the backhand curve.

BRIEF DESCRIPTION OF DRAWINGS

The invention is illustrated by way of example in the accompanying drawings which form part of this application and in which:

Referring to FIG. 1 there is shown the blade 10 of this invention having a forehand curve 12 and a backhand curve 14. The blade 10 also includes a heel 18 as shown in FIG. 2. Again referring to FIG. 1 shown by dotted lines is a cut-away portion of a hockey puck 20 which is shown cupped by the backhand curve 14. The backhand curve 14 is preferably a longitudinal concave curve on the backhand side of the blade 10 which extends from the heel 18 to about the midpoint of the blade 10. As shown in the figures, the thickness of blade 10 is considerably less than the width or length of the blade, and the thickness of blade 10, and hence its cross section, is substantially uniform over a substantial portion of its length. In order to conform with official hockey rules the blade 10 may conveniently be no more than about twelve and one-half inches (12½") as measured from the heel to the opposite end of the blade. Further, in conformance with official rules, the width of the blade may be conveniently made no more than about three inches (3") no less than two inches (2") at any point along the blade 10. The width is substantially constant over the length of the blade 10. Also in conformance with official rules the curvature of the forehand curve 12 and the backhand curve 14 may be conveniently restricted to less than about one-half inch (½") as measured by the distance of a perpendicular line measured between a straight line drawn from any point at the heel 18 to the outer end of the blade 10 and the point of maximum curvature. Dimensional lines F and B describe the points at which the aforedescribed measurement may be taken for the forehand curve 12 and backhand curve 14 respectively. Still further in conformance with the official rules the length of the linear elongated handle is preferably made no longer than about fifty-eight inches (58") as measured from the bottom of the heel 18 to the opposite end of the handle.

Figures 1, 2, 3:
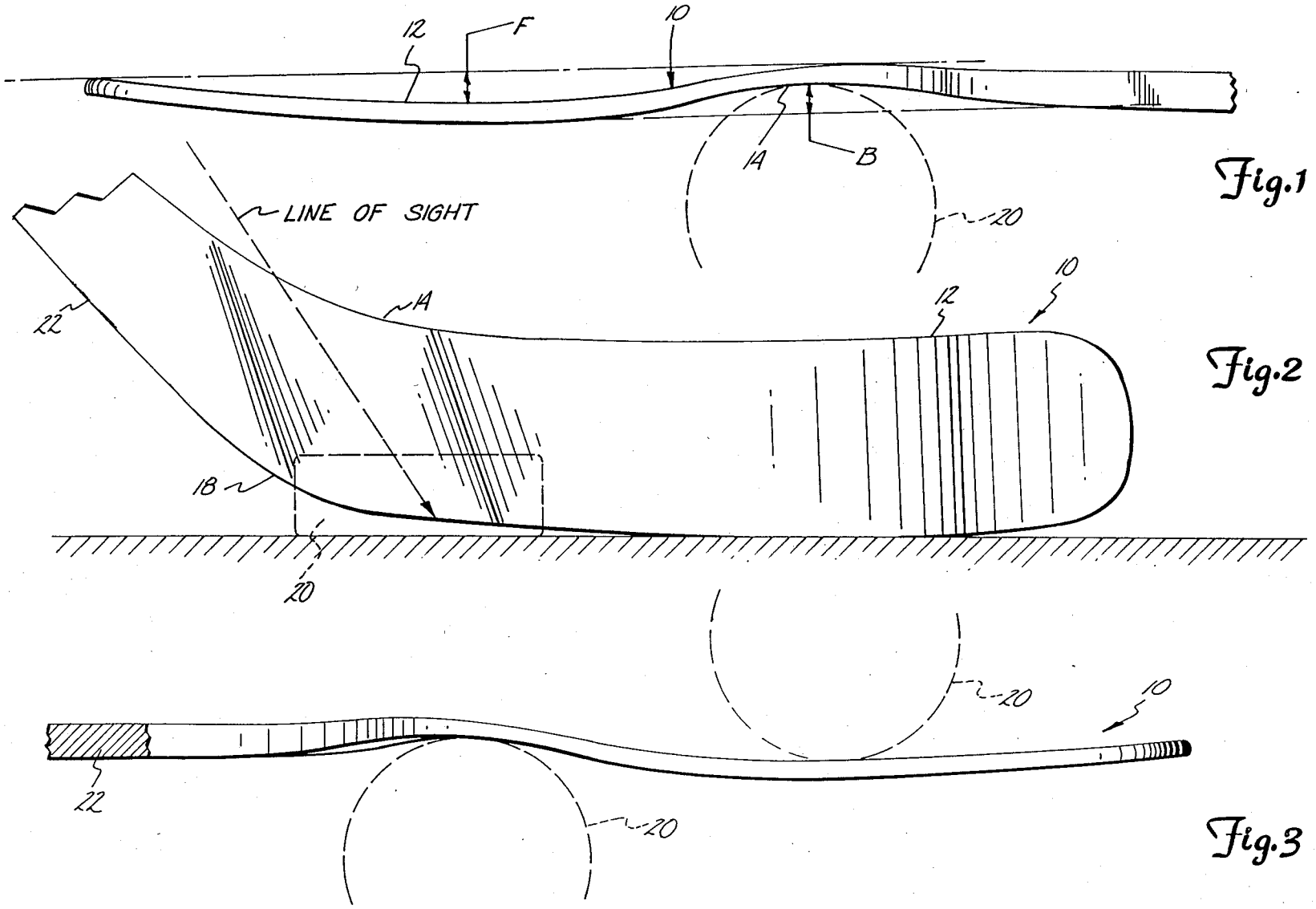
FIG. 1 is a bottom view of the hockey blade of this invention showing the backhand and forehand curves and showing in dotted lines the backhand puck position.
FIG. 2 is a view of the backhand side of the blade of this invention showing in dotted lines the line of sight and the backhand puck position.
FIG. 3 is a top view of the blade of this invention showing in dotted lines the backhand and forehand puck position.

The blade 10 of the present invention may be manufactured using woods, wood compositions, and wood and plastic compositions well known in the hockey stick art. Examples of hockey stick construction are discussed in U.S. Pat. Nos. 4,059,269 to A. Tiitola and 4,052,499 to M. Coupil et al. It is also recognized that the present invention may be manufactured entirely of plastic or metal, such as might be used for informal street hockey purposes.

Referring to FIG. 2 a side view of the blade 10 of this invention shown. In one embodiment of the invention the blade 10 may be conveniently formed by a process of alternately sanding and applying epoxy resins and fiberglass sheeting on a conventional blade until the desired new design is achieved. Also shown by a dotted line pointing through a backhand curve 14 is a line of sight to the backhand side. By means of the line of sight a hockey player may more easily view a puck 20 as shown by a rectangular dotted line outline. The line of sight is defined by tapering the backhand side inward from the heel 18 to about the midpoint of the backhand curve 14.

FIG. 3 shows a top view of the blade 10 of this invention. Shown in dotted lines are cut-away views of pucks 20 shown positioned by the backhand curve 14 and the forehand curve 12, respectively. A linear elongated handle (not shown) is secured to the inner end 22 of the blade 10 by means well known in the hockey stick art, forming as obtuse angle approximately parallel to the line of sight as shown in FIG. 2.

In an alternate embodiment of this invention the inner end 22 comprises a fastening means by which a separate linear, elongated handle with cooperative fastening means may be secured to the blade 10. In one mode of the invention the fastening means may be a sleeve into which one end of a handle may be fitted and secured by applying a suitable glue.

While there has been shown and described a preferred embodiment of a stick of the type used in hockey and improved blade design thereof, it is understood that changes in the structure and materials of the ice hockey stick and the method of making the ice hockey stick can be made by those skilled in the art without departing from the invention.

What is claimed is:

1. A stick to be used for ice hockey or the like, comprising:

an elongated linear handle; and a blade of predetermined length, width and thickness with the thickness considerably less than the length or width of the blade, the blade width being substantially constant over its length and the blade having a cross section of substantially uniform thickness over a substantial portion of its length, the blade comprising an inner end defining a heel, an outer end, opposed faces respectively defining a forehand side and a backhand side, a first longitudinal concave curve formed in the backhand side beginning at the heel and terminating at about the midpoint of the blade, a second longitudinal concave curve formed in the forehand side beginning at about the point of maximum curvature of the first longitudinal concave curve and terminating at the outer end;

the blade being secured to the elongated linear handle at its inner end and forming an obtuse angle with the handle.

2. A stick to be used for ice hockey or the like as set forth in claim 1 wherein the backhand side of the blade is tapered inward from the heel to about the midpoint of the first longitudinal concave curve whereby a line of sight is provided to the backhand side.

3. A stick to be used for hockey or the like as set forth in claim 1 wherein the first longitudinal concave curve on the backhand side and the second longitudinal concave curve on the forehand side each has a maximum curvature of no more than about one-half inch as measured by a perpendicular line measured between a straight line drawn from any point at the heel to the outer end of the blade and the point of maximum curvature.

4. In a stick to be used for hockey or the like, including an elongated linear handle, a blade of predetermined length, width and thickness with the thickness considerably less than the length and width, the blade width being substantially constant over its length and the blade having a cross section of substantially uniform thickness over a substantial portion of its length, the blade further including an inner end defining a heel, an outer end, opposed faces respectively defining a forehand side and a backhand side, and the blade being secured to the elongated linear handle at the heel, the improvement which comprises a first longitudinal concave curve formed in the backhand side of the blade beginning at the heel and terminating at about the midpoint of the blade, and a second longitudinal concave curve formed in the forehand side of the blade beginning at about the point of maximum curvature of the first longitudinal curve and terminating at the outer end.

5. An improvement to a stick to be used for ice hockey or the like as set forth in claim 4 wherein the backhand side of the blade is tapered inward from the heel to about the mid-point of the first longitudinal concave curve whereby a line of sight is provided to the backhand side.

6. An improvement to a stick to be used for ice hockey or the like as set forth in claim 4 wherein the first longitudinal concave curve on the backhand side and the second longitudinal concave curve on the forehand side each have a maximum curvature of no more than about one-half inch as measured by a perpendicular line measured between a straight line drawn from any point at the heel to the outer end of the blade and the point of maximum curvature.

7. A blade to be used for ice hockey or the like of predetermined length, width and thickness with the thickness considerably less than the length and width of the blade, the blade width being substantially constant over its length and the blade having a cross section of substantially uniform thickness over a substantial portion of its length, the blade comprising an inner end defining a heel, an outer end, opposed faces respectively defining a forehand side and a backhand side, a first longitudinal concave curve formed in the backhand side beginning at the heel and terminating at about the midpoint of the blade, a second longitudinal concave curve formed in the forehand side beginning at about the point of maximum curvature of the first longitudinal curve and terminating at the outer end such that at least the midpoint of said blade lies substantially on the forehand side of a straight line lying substantially parallel to the longitudinal direction of said blade and extending from the backhand face of said heel to the point of maximum curvature of said second longitudinal concave curve and the top of the inner end of the blade being constructed for connection to an elongated linear handle to define an obtuse angle between the blade and the elongated linear handle.

8. The blade defined by claim 7, wherein the point of maximum curvature of the first longitudinal curve in the outer end of the blade are disposed in substantial longitudinal alignment.

* * * * *